United States Patent [19]

Cassia

[11] Patent Number: 4,673,109

[45] Date of Patent: Jun. 16, 1987

[54] LIQUID SOAP DISPENSING SYSTEM

[75] Inventor: Antonio M. Cassia, Milan, Italy

[73] Assignee: Steiner Company, Inc., Chicago, Ill.

[21] Appl. No.: 788,964

[22] Filed: Oct. 18, 1985

[51] Int. Cl.[4] ..... B67D 5/06

[52] U.S. Cl. ..... 222/153; 222/181; 222/185; 222/209; 222/214; 222/383; 222/508

[58] Field of Search ..... 222/181, 185, 207, 209, 222/212, 213, 214, 215, 103, 105, 383, 380, 153, 505, 508, 372

[56] References Cited

U.S. PATENT DOCUMENTS

| | | | |
|---|---|---|---|
| 1,326,880 | 1/1919 | Rose | 222/207 |
| 2,565,917 | 3/1948 | Hammerstein | 222/490 |
| 2,605,021 | 7/1949 | Churchill et al. | 222/153 |
| 3,066,832 | 12/1962 | Rossetti | 222/207 |
| 3,539,081 | 11/1970 | Norton | 222/185 |
| 3,870,201 | 3/1975 | Asplund | 222/207 |
| 3,926,347 | 12/1975 | Low et al. | 222/185 |
| 4,018,363 | 4/1977 | Cassia | 222/80 |
| 4,166,553 | 9/1979 | Fraterrigo | 222/181 |
| 4,214,676 | 7/1980 | Cassia | 222/83.5 |
| 4,330,071 | 5/1982 | Ohlson | 222/207 |
| 4,345,627 | 8/1982 | Cassia | 22/325 X |
| 4,350,268 | 9/1982 | Potter | 222/214 |
| 4,360,130 | 11/1982 | Nishimura et al. | 222/153 |
| 4,394,938 | 7/1983 | Frossanito | 222/207 |
| 4,398,653 | 8/1983 | Daloisio | 222/185 |
| 4,530,448 | 7/1985 | Ponyicky | 222/181 |
| 4,560,093 | 12/1985 | Cassia | 222/181 |
| 4,561,571 | 12/1985 | Chen | 222/181 X |

*Primary Examiner*—L. J. Paperner
*Assistant Examiner*—Jay I. Alexander
*Attorney, Agent, or Firm*—Emrich & Dithmar

[57] ABSTRACT

A liquid soap dispensing system includes a molded plastic housing adapted to receive a disposable refill cartridge containing liquid soap. Rails on the housing engage in recesses on the cartridge to guide vertical movement of the cartridge to its mounted use position, in which position it is latched by a latch member pivotally carried by the housing and engageable with the outlet neck of the cartridge. The neck carries a compressible discharge nipple engageable by a pump member actuated by a handle for discharging soap. Bias means holds the latch means in its latched condition and the pump member and handle in their normal rest positions. The dispenser includes a minimal number of parts which can be assembled without the use of fasteners. A key is provided for releasing the latch member to permit removal of a spent cartridge.

21 Claims, 13 Drawing Figures

25
30
23
35
36
37
39
41
116
40
105
22
21
33
39a
68
69
70
67
34
37
53
46
54
32
36
35
31

35
32
35
36
36
33
107
105
106
93
54
108
34
111
109
116
112
37
37
31
48a
48
41
45
66
110
64
63
42
43
113
52

40
52
42
63
64
44
65
43
46
110
55
86
56
87
83
49
81
66
45
41
113
50

91
38
62
116
53
68
37
85
46
47
31
48
49
56
110
41
70
86
42
80
43
113

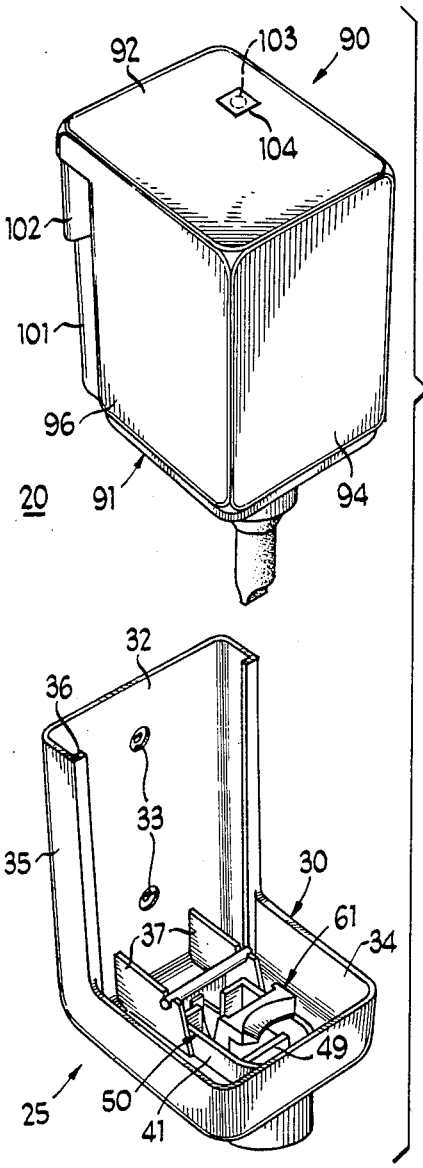
Fig 8
Fig 9
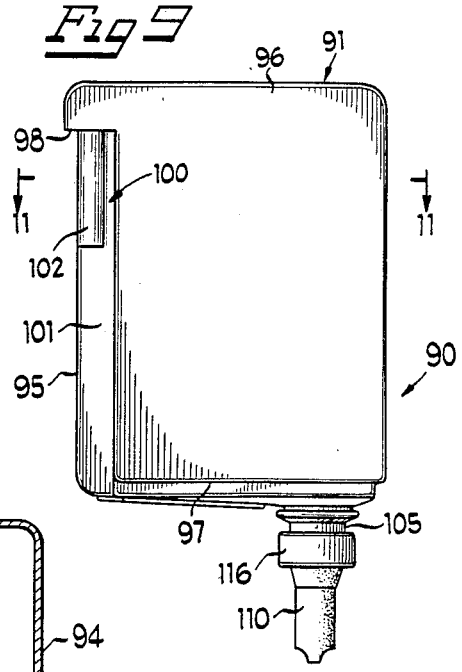
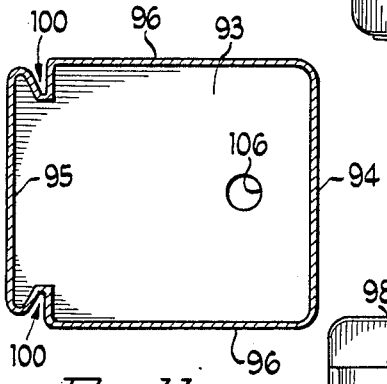
Fig 11
Fig 10
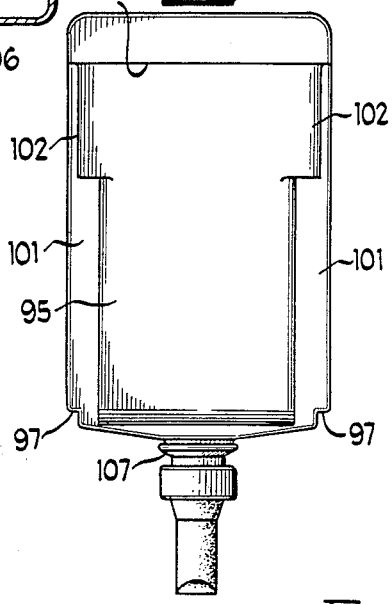
Fig 13
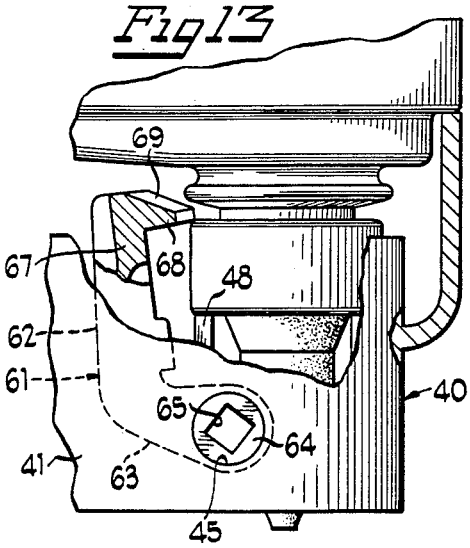
Fig 12
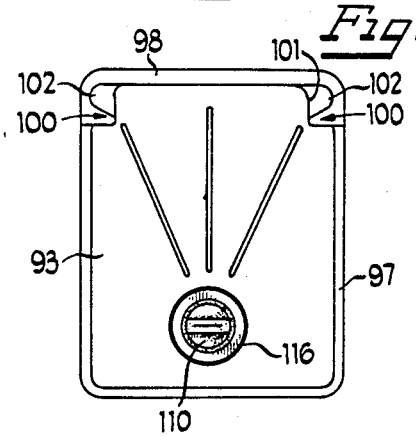

LIQUID SOAP DISPENSING SYSTEM

BACKGROUND OF THE INVENTION

The present invention relates to apparatus for dispensing liquid soap, normally in discrete small quantities or charges. Such dispensing apparatus is used, particularly for hygienic purposes, in public or institutional washrooms or the like or wherever there are a relatively large number of different users.

One prior type of soap dispenser utilizes a container or cartridge of liquid soap which is removably mounted on a dispensing apparatus so that it can be replaced by another cartridge when it is empty. Such a dispenser is disclosed in U.S. Pat. No. 1,326,880. However, the soap container of that dispenser is of the refillable type. This means that the spent containers must be collected, sterilized and refilled and sealed for reuse, which is a time consuming and expensive operation. Because the container is refillable, it has a refill opening which, although normally closed, is accessible to users and could permit contamination of the contents or refilling with soap from an unauthorized source. Furthermore, the container is readily removable from the dispenser by any user, so that the entire container could easily be replaced by a "bootleg" container.

To avoid this problem, it is known to provide dispensers with closed, lockable cabinets in which the refill cartridge or container is enclosed, so as to prevent access by unauthorized persons. But this type of housing is relatively expensive. Furthermore, such prior dispensers have been relatively complex construction, frequently using a large number of parts, the assembly of which entails substantial labor.

SUMMARY OF THE INVENTION

It is a general object of the present invention to provide an improved liquid soap dispensing system which avoids the disadvantages of prior dispensing apparatus while affording additional structural and operating advantages.

An important object of the invention is the provision of a liquid soap dispensing system which is of simple and economical construction, characterized by a minimal number of parts and great ease of assembly.

Another object of the invention is the provision of a dispensing system of the type set forth, which utilizes a disposable refill cartridge and which is characterized by ease and simplicity of mounting and demounting of the cartridge.

In connection with the foregoing objects, it is another object of the invention to provide a dispensing system of the type set forth, wherein the cartridge is automatically locked in place on the dispenser.

Yet another object of the invention is the provision of a unique dispenser for use in such a dispensing system.

Another object of the invention is the provision of a unique disposable cartridge for use in such a dispensing system.

Certain of these objects are attained by providing, in a liquid soap dispensing system including a housing and a discharge mechanism carried thereby for movement between a normal retracted configuration and an actuating configuration for dispensing liquid soap from an outlet portion of an associated cartridge, the improvement comprising: latch means carried by the housing for movement between a latching condition engageable with the outlet portion of the associated cartridge for locking it in a dispensing position on the housing and an unlatching condition, and bias means interconnecting said latch means and the discharge mechanism for resiliently urging the latch means to its latching condition and the discharge mechanism to its retracted configuration.

Other objects of the invention are attained by providing a disposable refill cartridge for a liquid soap dispenser, the cartridge comprising: a closed container having a bottom wall portion and a rear wall portion and two opposed side wall portions, an outlet opening formed in the bottom wall portion, means closing the outlet opening, and two elongated recesses respectively formed in the side wall portions adjacent to the rear wall portion, each of the recesses extending downwardly to said bottom wall portion.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 8 is an exploded perspective view illustrating the relationship between the disposable cartridge and the dispenser of the dispensing system of FIG. 1;

FIG. 9 is a side elevational view of the disposable cartridge of FIG. 8;

FIG. 10 is a rear elevational view of the disposable cartridge of FIG. 9;

FIG. 11 is a view in horizontal section taken along the line 11—11 in FIG. 9;

FIG. 12 is a bottom plan view of the disposable cartridge of FIG. 9; and FIG. 13 is an enlarged fragmentary view of the lower front portion of the dispensing system of FIG. 1, partially in side elevation and partially in section, illustrating the latch member in its unlatched position.

Description of the Preferred Embodiment

Figure 1:
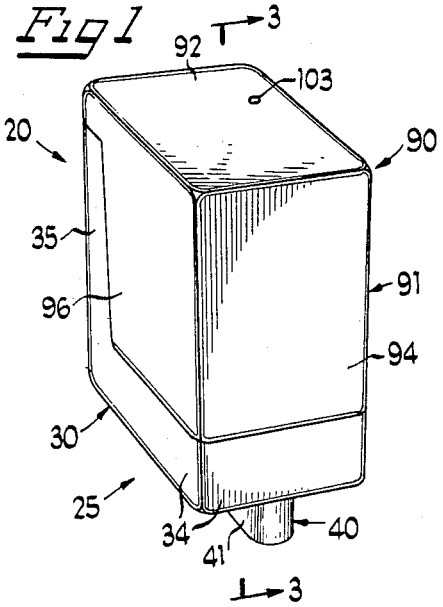
FIG. 1 is a perspective view of a soap dispensing system, constructed in accordance with and embodying the features of the present invention.
Figure 3:
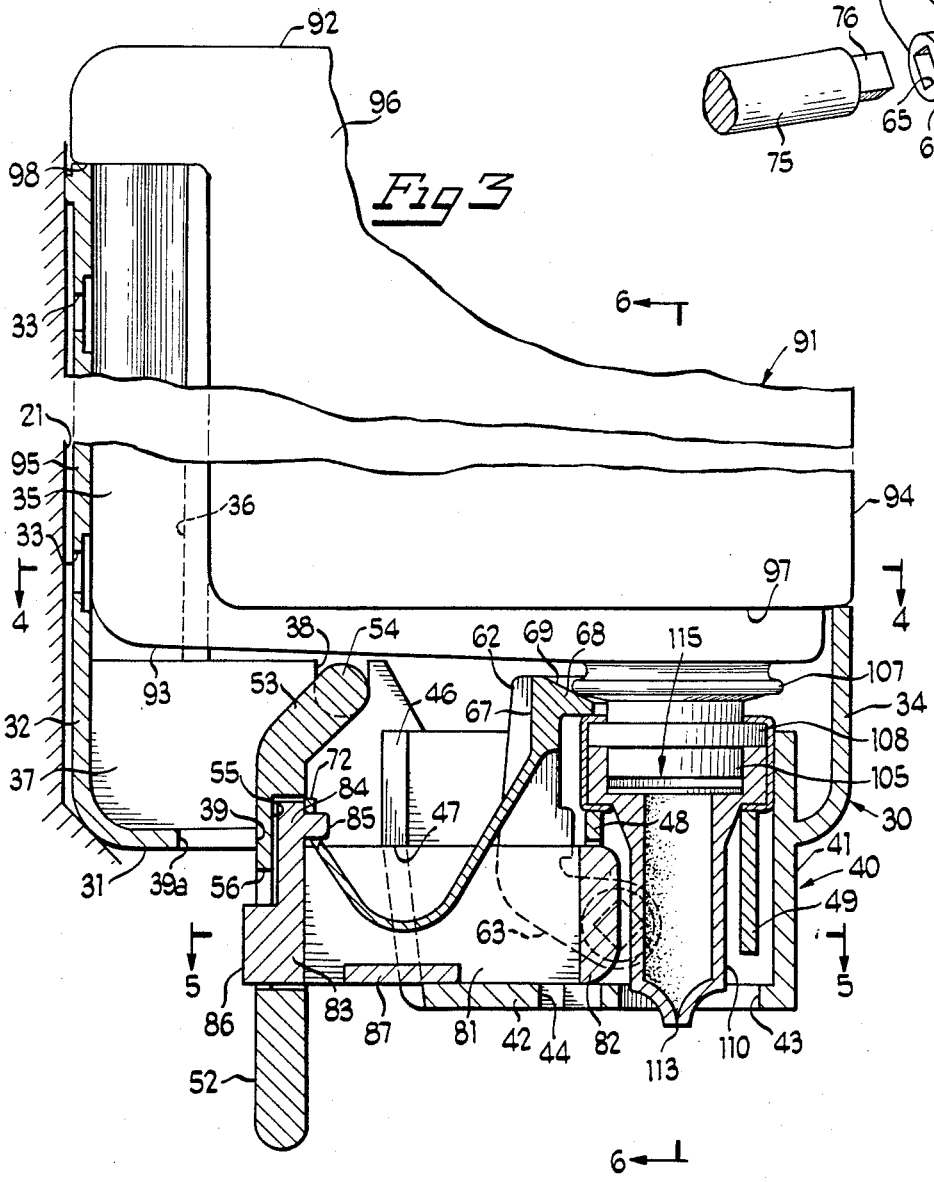
FIG. 3 is a further enlarged, fragmentary view in vertical section taken along the line 3—3 in FIG. 1, and illustrating the discharge assembly in its normal rest configuration.
Figure 4:
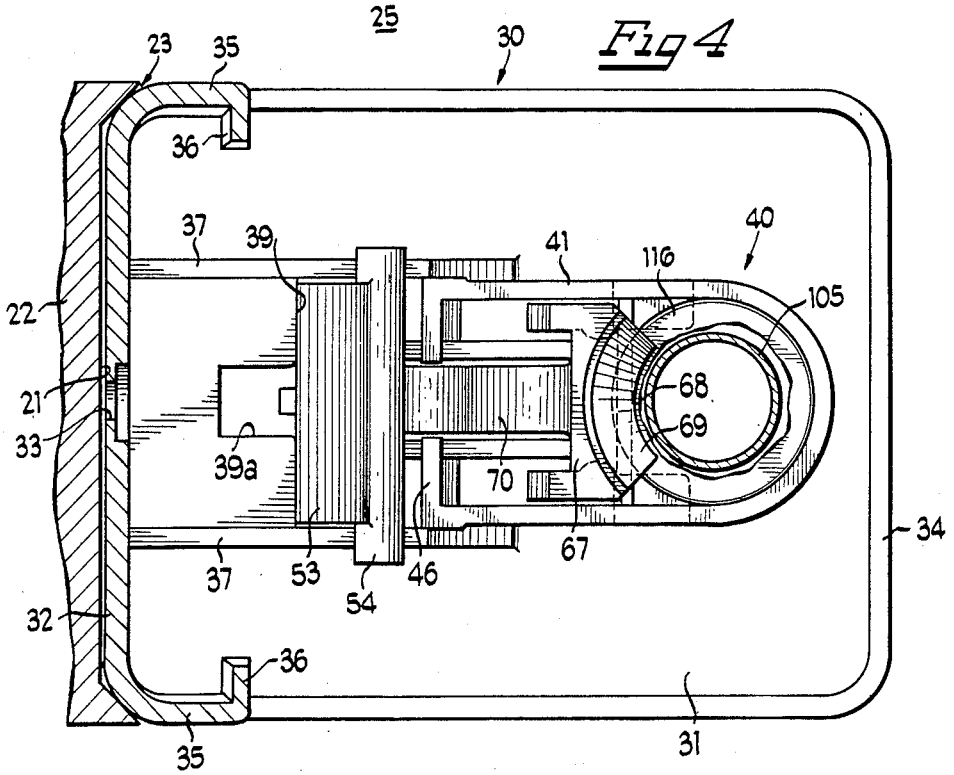
FIG. 4 is a view in horizontal section taken along the line 4—4 in FIG. 3.

Referring to FIGS. 1 and 8, there is illustrated a soap dispensing system, generally designated by the numeral 20, constructed in accordance with and embodying the features of the present invention. The soap dispensing system 20 comprises a dispenser 25 adapted to be mounted on an associated support surface 21, such as on a wall 22 and, more particularly, in a recess 23 therein (see FIGS. 3 and 4), and a disposable cartridge 90 which contains a supply of liquid soap and is removably mountable on the dispenser 25 for cooperation therewith to control the dispensing of liquid soap therefrom.

Referring also to FIGS. 3 through 6, the dispenser 25 includes a housing 30, which is preferably of unitary, one-piece construction and may be formed of molded plastic. The housing 30 includes a flat rectangular base wall 31 and an upstanding rectangular mounting wall 32 integral with the base wall 31 at the rear edge thereof and disposed substantially perpendicular thereto. The mounting wall 32 may have fastener holes 33 therethrough for receiving associated fasteners (not shown), securely to mount the housing 30 on the associated support surface 21. Integral with the base wall 31 and extending upwardly therefrom along the front and side edges thereof is a continuous peripheral flange 34. Side flanges 35 are respectively integral with the side edges of the mounting wall 32 and project forwardly therefrom to join the peripheral flange 34.

Respectively integral with the side flanges 35 at the forward or distal edges thereof, and projecting laterally inwardly therefrom substantially parallel to the mounting wall 32, are two retaining rails 36, each extending the entire length of the mounting wall 32 to the base wall 31. Integral with the base wall 31 and with the mounting wall 32 and substantially perpendicular to each are a pair of laterally spaced-apart, upstanding support plates 37, respectively provided with laterally aligned bearing notches 38 in the upper edges thereof (see FIG. 3). Formed in the base wall 31 is an elongated, generally rectangular opening 39 (FIGS. 3 and 4) which extends laterally between the support plates 37, the opening 39 having a rearwardly extending rectangular arm 39*a* and having an arcuate forward end. Integral with the housing 30 is a receptacle 40 having a peripheral wall 41 which lines the forward portion of the opening 39, the peripheral wall 41 having an arcuate front end and parallel side portions, which side portions are respectively parallel to the support plates 37 and are integral with the inner surfaces thereof at the front ends thereof. The peripheral wall 41 projects above and below the base wall 31 and is closed at its lower end by a bottom wall 42 which is disposed substantially parallel to the base wall 31. The bottom wall 42 has a circular opening 43 therein adjacent to the forward end thereof, and a generally T-shaped slot 44 therethrough (FIG. 3) just rearwardly of the circular opening 43. Respectively formed in the side portions of the peripheral wall 41 below the base wall 31 are two laterally aligned circular pivot openings 45 (see FIG. 5).

Integral with the rear ends of the side portions of the peripheral wall 41 and projecting laterally inwardly therefrom are two rear flanges 46, each having a notch or recess 47 at the lower end thereof. A stop web 48 laterally spans the side portions of the peripheral wall 41, extending a slight distance above and below the base wall 31, the web 48 having a rectangular notch 48a (FIG. 6) in the lower edge thereof. A rectangular stop web 49 is disposed substantially parallel to the stop web 48 and defines a chord across the arcuate front end of the peripheral wall 41, the upper edges of the stop webs 48 and 49 lying substantially in a common horizontal plane.

Figure 2:
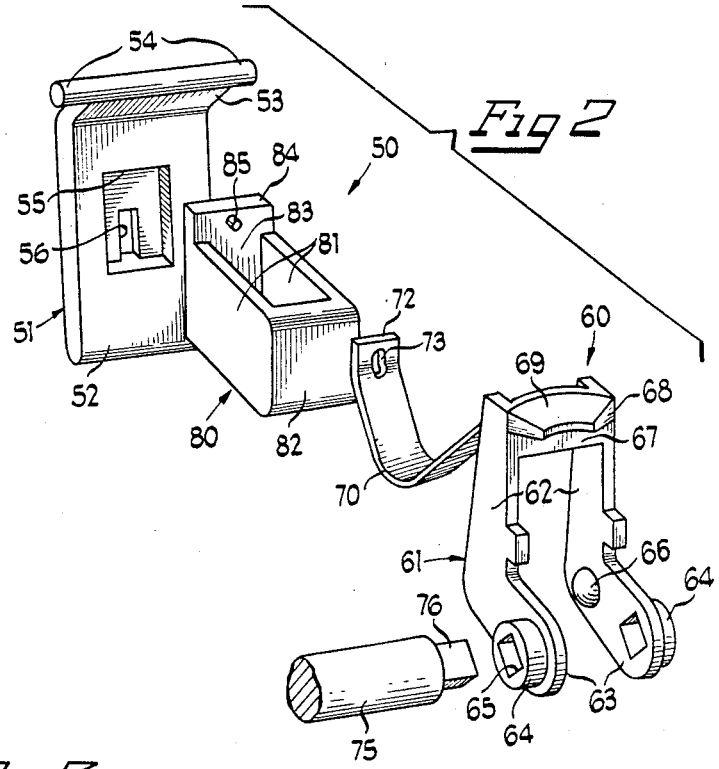
FIG. 2 is an enlarged, exploded, perspective view, with portions broken away, of the discharge assembly of the soap dispensing system of FIG. 1.
Figure 7:
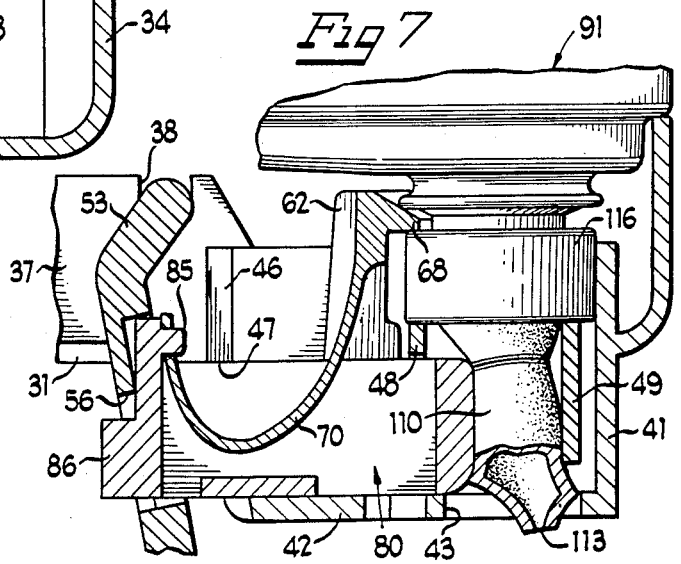
FIG. 7 is a fragmentary view of the lower righthand portion of FIG. 3, illustrating the discharge assembly in its actuating configuration.

Referring now also to FIGS. 2, 7 and 13, the dispenser 25 also includes a discharge assembly 50 which is removably mounted in the housing 30. The discharge assembly 50 includes a handle 51 comprising a rectangular plate 52 provided at its upper end with an inclined portion 53, which is in turn provided at its distal end with laterally outwardly extending cylindrical pivot lugs 54. In use, the handle 51 is adapted to be dropped into the housing 30 between the support plates 37 and through the opening 39 in the base wall 31, the pivot lugs 54 being respectively received in the bearing notches 38 for pivotally supporting the handle 51 for movement between actuating and retracted positions. The plate 52 has a width slightly less than the width of the opening 39, so that the base wall 31 at the rear end of the opening 39 and the rear flanges 46 of the receptacle 40 provide rear and front stops to limit the pivotal movement of the handle 51. Formed in the front surface of the plate 52 is a rectangular recess 55, in the lower end of which is formed a rectangular slot 56 which extends through the thickness of the plate 52 midway between the side edges thereof and in position so as to be disposed below the base wall 31 when the handle 51 is disposed in its mounted condition in the housing 30.

The discharge assembly 50 also includes a bias unit 60 which comprises a latch member 61 and a bias leaf 70. The latch member 61 is generally in the form of a clevis having a pair of parallel, spaced-apart arms 62, respectively provided with angled feet 63, at the lower ends thereof. The feet 63 are respectively provided with laterally outwardly extending circularly cylindrical pivot lugs 64, each having a substantially square key socket 65 formed in the outer end thereof, which may extend laterally completely therethrough.

Each of the feet 63 is also provided on its inner surface with a bearing boss 66. The arms 62 are interconnected at their upper ends by a bight portion 67 provided with a forwardly extending latch flange 68 having a part frustoconical cam surface 69 thereon. The latch member 61 is dimensioned to fit within the receptacle 40 with the arms 62 respectively disposed along the inner surfaces of the side portions of the peripheral wall 41. For mounting, the arms 62 are resiliently deflected together to permit the pivot lugs 64 to clear the inner surfaces of the peripheral wall 41, and then the latch member 61 is lowered into the receptacle 40 until the pivot lugs 64 respectively snap out into the pivot openings 45, pivotally to mount the latch member 61. The length of the arms 62 is such that when the latch member 61 is in this mounted condition, the latch flange 68 is disposed a predetermined distance above the upper end of the receptacle 40.

The bias leaf 70 comprises a thin, flat, rectangular band which is formed of a suitable flexible and resilient material, such as a suitable plastic. One end of the bias leaf 70 is fixedly secured to the rear surface of the bight portion 67 of the latch member 61 by suitable means (not shown). The bias leaf 70 is fabricated with a predetermined curvature therein, and is provided with a curved tip 72 at its distal end which has a rectangular slot 73 therethrough for a purpose to be explained more fully below. There is also provided a key 75 having a lug 76 thereon which is disposed for mating engagement in one of the key sockets 65 to effect manual rotation of the latch member 61 about the axis of the pivot lugs 64, for a purpose which will be explained below.

The discharge assembly 50 also includes a pump member 80, which is generally in the shape of a rectangular, box-like, open-top frame. More particularly, the pump member 80 includes a pair of parallel rectangular side walls 81 interconnected, respectively, at the forward and rearward ends thereof by a front bearing wall 82 and a rear wall 83. The rear wall 83 has an extension portion 84 which projects upwardly above the upper edges of the side walls 81 and is provided with a forwardly extending pin 85. Integral with the outer or rear surface of the rear wall 83 is a rearwardly extending rectangular positioning lug 86. The side walls 81 are interconnected at the lower edges thereof, intermediate the front and rear ends thereof by a rectangular bottom web 87. The pump member 80 is dimensioned so that it can fit between the notches 47 of the receptacle rear flanges 46, through the notch 48a in the stop web 48 and between the bearing bosses 66 of latch member 61 for reciprocating siding movement forwardly and rearwardly along the bottom wall 42 of the receptacle 40 between pumping and release positions.

It is a significant aspect of the present invention that the parts of the discharge assembly 50, viz., the handle 51, the bias unit 60 and the pump member 80, can be quickly and easily assembled with the housing 30 without the use of tools and, when thus assembled, will cooperate with each other and with the housing 30 to retain the discharge assembly 50 in the housing 30 and prevent accidental removal thereof. More specifically, during assembly, the latch member 61 is first mounted in the receptacle 40 in the manner described above. When thus mounted, the latch flange 68 will extend forwardly and the bias leaf 70 will extend rearwardly.

Next, the pump member 80 is mounted in the receptacle 40. For this purpose, the front end of the pump member 80 is inserted upwardly and forwardly into the receptacle 40 between the notches 47 in the rear flanges 46, the arm 39*a* of the opening 39 providing clearance for the extension portion 84 of the rear wall 83. The pump member 80 is slid forwardly through the notch 48*a* in the stop web 48 and between the bearing bosses 66 on the latch member feet 63. The bias leaf 70 is received down into the pump member 80 and the pin 85 is inserted through the slot 73 of the bias leaf 70 so that the bias leaf 70 bears against the rear wall 83 of the pump member 80.

Next, the handle 51 is mounted. For this purpose, the pump member 80 is slid forwardly against the urging of the bias leaf 70 to provide clearance so that the handle plate 52 can be dropped down through the opening 39 behind the receptacle rear flanges 46. It will be appreciated that the arms 62 of the latch member 61 bear against the rear surface of the stop web 48 to limit forward pivotal movement of the latch member 61 when the pump member 80 is slid forwardly. The handle 51 is then dropped into position with the pivot lugs 54 disposed in the bearing notches 38, as explained above. The pump member 80 is then released and it slides rearwardly under the urging of the bias leaf 70 to a normal rest position, illustrated in FIG. 3, wherein the rear wall 83 seats in the recess 55 of the handle plate 52 and bears thereagainst to hold the handle 51 in its retracted position against the rear end of the opening 39. The positioning lug 86 is received in the slot 56, effectively to prevent upward movement of the handle 51 from its mounted condition. Thus, it will be seen that the handle 51 and the pump member 80 cooperate to hold each other in their mounted conditions. In order to disassemble the discharge assembly 50, the abovedescribed assembly procedure is simply reversed.

Referring now also to FIGS. 9–12 of the drawings, the cartridge 90 includes a generally box-like container 91, which may be formed of a suitable plastic material. Preferably, the container 91 is generally in the form of a rectangular parallelepiped having a top wall 92, a bottom wall 93, a front wall 94, a rear wall 95 and a pair of opposed side walls 96. The front wall 94 and the side walls 96 are set back or recessed along their lower edges adjacent to their junction with the bottom wall 93 to define a support shoulder 97. The top wall 92 projects rearwardly a slight distance beyond the rear wall 95 to form an overhang which defines a stop flange 98. Formed in the container 91 at the junctions of the rear wall 95, respectively, with the side walls 96, are two elongated longitudinal grooves 100 which extend from the level of the stop flange 98 downwardly to the bottom wall 93. The lower portions of the grooves 100 are cut away, as at 101, so as to define lugs 102 adjacent to the upper ends of the grooves 100. The top wall 92 of cartridge 90 has a hole 103 extending therethrough (see FIGS. 1 and 8) which is closed by a suitable cover 104. In use the cover 104, which may be a sticker or label is removed to permit air to enter the cartridge 90, for a purpose to be explained.

Figure 6:
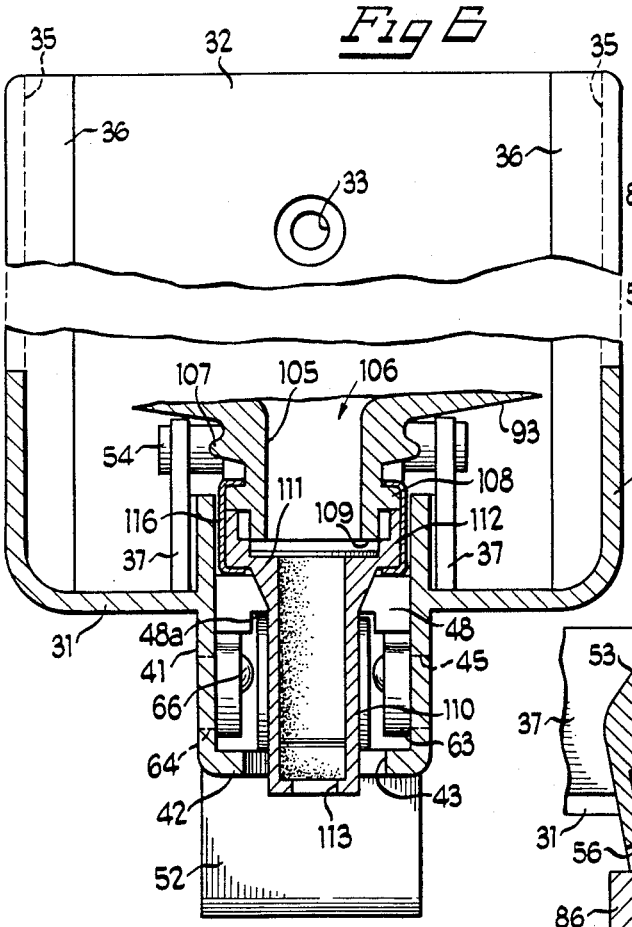
FIG. 6 is a vertical sectional view with portions removed, taken along the line 6—6 in FIG. 3.
Figure 5:
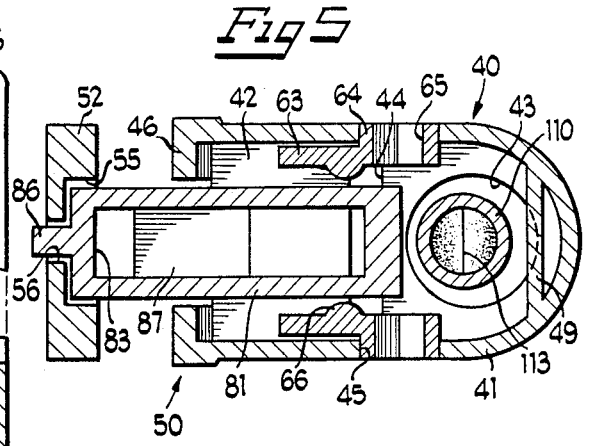
FIG. 5 is a view in horizontal section taken along the line 5—5 in FIG. 3.

Integral with the bottom wall 93 adjacent to the forward end thereof is a cylindrical nozzle or neck 105 which projects downwardly from the bottom wall 93 and surrounds an outlet opening 106 therein (FIG. 6). The neck 105 has a radially outwardly extending circumferential rib 107 and a radially outwardly extending circumferential flange 108 which are spaced apart a slight distance longitudinally of the neck 105. The neck 105 terminates in an annular end surface 109. Secured to the neck 105 and depending therefrom is a compressible nipple 110 having an annular flange 111 at the upper end thereof which is integral with an upstanding cylindrical wall 112 adapted to surround the lower end of the neck 105 and abut against the circumferential flange 108. The nipple 110 is provided with a normally-closed discharge slit 113 at its distal end.

Trapped between the flange 111 and the end surface 109 of the neck 105 is a check valve assembly 115 (FIG. 3), the parts being clamped together by a cylindrical retainer clip 116 (FIGS. 6 and 7) which securely holds the nipple 110 and the valve assembly 115 on the neck 105. The construction, assembly and operation of the neck 105, the nipple 110 and the valve assembly 115 are all described in greater detail in copending U.S. application Ser. No. 680,822, filed Dec. 12, 1984, now abondoned, entitled "Discharge Assembly for Liquid Soap Dispenser", and assigned to the assignee of the present invention.

Preferably, the cartridge 90 is inexpensive manufactured so as to be disposable. The container 91 is filled with liquid soap by the manufacturer or supplier of the cartridge 90 and the nipple 110 is then mounted in place. It is a significant aspect of the invention that the cartridge 90 can be readily mounted and demounted with respect to the dispenser 25 without the use of tools other than the key 75. In mounting the cartridge 90, it is placed over the dispenser 25 with the neck 105 disposed downwardly. The cartridge 90 is slid down along the mounting wall 32 of the housing 30, with the retaining rails 36 being respectively received in the longitudinal grooves 100. As the cartridge 90 is lowered into its use position, the nipple 110 extends downwardly into the receptacle 40 between the stop webs 48 and 49 and in coaxial alignment with the circular opening 43 in the bottom wall 42. After the cartridge 90 is mounted, the cover 104 is removed establishing communication between the inside and the outside of the container 91 by the hole 103.

In its normal rest condition, the latch flange 68 of the latch member 61 projects forwardly beyond the stop web 48 so as to obstruct the path of the neck 105. More particularly, the lower end of the retainer clip 116 engages the cam surface 69 and cams the latch member 61 into pivotal movement rearwardly to accommodate passage of the retainer clip 116. As soon as the retainer clip 116 has moved past the latch flange 68, it snaps back forwardly under the urging of the bias leaf 70 into the space between the circumferential rib 107 and the circumferential flange 108 for engagement with the latter to prevent retrograde movement of the cartridge 90. As soon as the retainer clip 116 cams past the latch flange 68, the lower end of the retainer clip 116 seats on the upper edges of the stop webs 48 and 49 to support the cartridge 90 in its normal mounted or use position, illustrated in FIGS. 3, 7 and 13, in which position the lower end of the nipple 110 projects a very slight distance below the bottom of the receptacle 40 through the circular opening 43 therein.

The container 91 is dimensioned so that when the cartridge 90 is disposed in its use position on the dispenser 25, the upper edge of the peripheral flange 34 of the housing 30 is disposed for engagement with the support shoulder 97 of the container 91 and the upper edge of the mounting wall 32 is disposed for engagement with the stop flange 98. Preferably, the stop flange 98 wraps around the sides of the container 91 for engagement with the upper ends of the side flanges 35 of the housing 30. The parts are all dimensioned so that when the cartridge 90 is disposed in its use position on the dispenser 25, the outer surfaces of the front wall 94 and the side walls 96 are, respectively, substantially coplanar with the corresponding portions of the outer surface of the housing peripheral flange 34, and the outer surface of the side walls 96 are, respectively, substantially coplanar with the outer surfaces of the housing side flanges 35 so as to present an attractive, smooth outward appearance. It will be appreciated that when the cartridge 90 is disposed in its use position, the lugs 102 engage the upper ends of the retaining rails 36, effectively to prevent forward tilting movement of the cartridge 90 with respect to the dispenser 25.

The venting of the container 91 through the vent hole 103 prevents a vacuum from being established in the container and results in dispensing consecutive doses of soap of substantially the same volume. Alternatively, the cartridge 90 may be vented through the neck 105 and the nipple 110 in the manner described in greater detail in the copending U.S. application Ser. No. 749,736, filed June 28, 1985, now allowed, entitled "Vented Discharge Assembly For Liquid Soap Dispenser", and assigned to the assignee of the present invention.

The check valve assembly 115 normally permits liquid soap to flow downwardly through the neck 105 to fill the nipple 110 with a charge of liquid soap. In order to dispense this charge of liquid soap, a user places his palm under the nipple 110 and pulls the handle 51 forwardly to its actuating position with his fingers, as indicated by the arrow in FIG. 7. This drives the pump member 80 forwardly to its pumping position and into engagement with the nipple 110, compressing it and ejecting the charge of liquid soap therefrom through the discharge slit 113, this compression also serving to close the check valve assembly 115 to prevent liquid soap from flowing back up from the nipple 110 into the neck 105. When the handle 51 is released, the pump member 80 returns to its release position and the handle 51 is returned to its retracted position under the urging of the bias leaf 70. The check valve assembly 115 reopens to permit a new charge of liquid soap to flow into the nipple 110.

When the cartridge 90 is spent, it is removed by the serviceman by the use of the key 75. As indicated in FIG. 2, the lug 76 is inserted in one of the key sockets 65 and rotated to pivot the latch member 61 rearwardly to an unlatching position, illustrated in FIG. 13, out of engagement with the retainer clip 116. This permits the cartridge 90 to be removed from the dispenser 25 and replaced with a full cartridge 90. It will be appreciated that when the key 75 is removed from the key socket 65, the latch member 61 pivots back to its normal rest or latching position under the urging of the bias leaf 70.

In a constructional model of the present invention, the handle 51, the latch member 61, the bias leaf 70, the pump member 80 and the key 75 are all preferably of unitary, one-piece construction. All of these parts may be molded of a suitable plastic material, although it will be appreciated that other suitable materials could be used. The container 91 may be formed of a transparent or translucent plastic material, so that a serviceman can readily determine how much liquid soap is left in the container 91.

From the foregoing, it can be seen that there has been provided an improved soap dispensing system which is of simple and economical construction, utilizing a dispenser which carries a discharge assembly and a disposable liquid soap cartridge removably mountable on the dispenser, wherein the cartridge is automatically latched in position on the dispenser to prevent unauthorized removal thereof, and the parts of the discharge assembly are few can be readily assembled and disassembled without the use of tools, and retain themselves in the assembled mounted condition without any fastening means.

I claim:

1. In a liquid soap dispensing system including a housing and a discharge mechanism carried thereby for movement between a normal retracted configuration and an actuating configuration for dispensing liquid soap from an associated cartridge, the improvement comprising: latch means carried by said housing for movement between a latching condition engageable with the associated cartridge for locking it in a dispensing position on the housing and an unlatching condition, and bias means interconnecting said latch means and the discharge mechanism for resiliently urging said latch means to its latching condition and said discharge mechanism to its retracted configuration.

2. The liquid soap dispensing system of claim 1, wherein the cartridge has an outlet portion, said latch means in the latching condition thereof being engageable with said outlet portion.

3. The liquid soap dispensing system of claim 1, wherein said latch means moves to its latched condition in response to movement of the cartridge to its dispensing position.

4. The liquid soap dispensing system of claim 1, and further including means mounting said latch means on said housing for pivotal movement between the latching and unlatching conditions thereof.

5. The liquid soap dispensing system of claim 4, wherein the housing has a pair of spaced-apart aligned openings therein, said latch means including a clevis-shaped member having a pair of pivot portions respectively rotatably receivable in said openings.

6. The liquid soap dispensing system of claim 1, and further including means for effecting movement of said latch means to the unlatching condition thereof for permitting removal of the container from the dispensing position thereof.

7. The liquid soap dispensing system of claim 6, wherein said release means includes a key engageable with said latch means.

8. A liquid soap dispenser having only a minimal number of parts which can be assembled without the use of fastening means for dispensing liquid soap from an associated cartridge which has a compressible outlet nipple, said dispenser consisting essentially of: a housing member having a receptacle portion and adapted to receive the associated cartridge in a use position with the nipple in said receptacle portion, a pump member freely receivable in said receptacle portion and movable therein between a pumping position for compressing the nipple to discharge liquid soap therefrom and a release position out of engagement with the nipple, a handle member carried by said housing member in a supported condition for engagement with said pump member, said handle member in its supported condition being pivotally movable between an actuating position for driving said pump member to its pumping position and a retracted position for accommodating movement of said pump member to its release position, said pump member in its pumping position accommodating free movement of said handle member to and from its supported condition on said housing member, said pump member and said handle member cooperating when engaged to retain said pump member in said receptacle and to retain said handle member in its supported condition, and a bias unit engageable with said housing member and said pump member for resiliently urging said pump member to its release position and into engagement with said handle member, thereby to urge said handle member to its retracted position.

9. The liquid soap dispenser of claim 8, wherein said bias unit includes a latch portion engageable with the associated cartridge for locking it in its use position.

10. The liquid soap dispenser of claim 9, wherein said bias unit includes an elongated flexible bias portion extending between said latch portion and said pump member.

11. The liquid soap dispenser of claim 10, wherein said bias portion is integral with said latch portion.

12. The liquid soap dispenser of claim 8, wherein each of said housing member and said pump member and said handle member is of unitary one-piece. construction.

13. The liquid soap dispenser of claim 8, wherein said bias unit is releasably snap-fitted into engagement with said housing member.

14. The liquid soap dispenser of claim 13, wherein said receptacle portion has a pair of spaced-apart aligned openings therein, said latch portion having a pair of flexible legs each having a pivot portion, with said pivot portions being respectively rotatably receivable in said openings.

15. A disposable refill cartridge for a liquid soap dispenser, said cartridge comprising: a closed container having a bottom wall portion and a rear wall portion and two opposed side wall portions, an outlet opening formed in said bottom wall portion, means closing said outlet opening, two elongated recesses respectively formed in said side wall portions adjacent to said rear wall portion, each of said recesses extending downwardly to said bottom wall portion, said container having stepped retaining surfaces at the upper end of said rear wall portion and at the lower ends of said side wall portions.

16. The refill cartridge of claim 15, wherein said container is substantially in the shape of a rectangular parallelepiped.

17. The refill cartridge of claim 15, and further including an outlet neck carried by said bottom wall portion and defining said outlet opening.

18. The refill cartridge of claim 17, and further including a compressible nipple carried by said neck, said nipple having a normally-closed discharge slit at the distal end thereof.

19. The refill cartridge of claim 18, and further including check valve means disposed between said nipple and said neck for permitting flow of liquid soap from said neck to said nipple while preventing flow of liquid soap from said nipple to said neck.

20. The refill cartridge of claim 15, and further including a vent hole therein establishing communication in use between the inside and outside of said cartridge.

21. The refill cartridge of claim 20, and further comprising means for interrupting communication establishing by said vent hole.

* * * * *

UNITED STATES PATENT AND TRADEMARK OFFICE

CERTIFICATE OF CORRECTION

PATENT NO. : 4,673,109

DATED : June 16, 1987

INVENTOR(S) : Antonio M. Cassia

It is certified that error appears in the above-identified patent and that said Letters Patent is hereby corrected as shown below:

Column 10, line 9, delete "." after piece

Column 10, lines 50-51, "establishing" should be --established--

Signed and Sealed this

First Day of March, 1988

*Attest:*

DONALD J. QUIGG

*Attesting Officer*

*Commissioner of Patents and Trademarks*